US006981458B2

(12) United States Patent
Ebata et al.

(10) Patent No.: US 6,981,458 B2
(45) Date of Patent: Jan. 3, 2006

(54) SEWING MACHINE WITH WORK EDGE CUTTING MECHANISM

(75) Inventors: Yoshikazu Ebata, Tokyo (JP); Masayoshi Takahashi, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 10/998,488

(22) Filed: Nov. 29, 2004

(65) Prior Publication Data

US 2005/0126459 A1 Jun. 16, 2005

(30) Foreign Application Priority Data

Dec. 12, 2003 (JP) ..... 2003-415818

(51) Int. Cl.
*D05B 37/04* (2006.01)

(52) U.S. Cl. ..... 112/122

(58) Field of Classification Search ..... 112/122.1, 112/122, 125, 129, 130; 83/910, 936, 938
See application file for complete search history.

(56) References Cited

U.S. PATENT DOCUMENTS 5,289,789 A * 3/1994 Sakuma ..... 112/122
5,427,041 A * 6/1995 Satoma ..... 112/125
5,813,356 A * 9/1998 Nolle ..... 112/122
6,101,960 A * 8/2000 Ebata et al. ..... 112/122

FOREIGN PATENT DOCUMENTS

JP 11-235489 8/1999

* cited by examiner

*Primary Examiner*—Ismael Izaguirre
(74) *Attorney, Agent, or Firm*—Nields & Lemack

(57) ABSTRACT

Disclosed is a sewing machine with work edge cutting mechanism having an upper blade 13*a* which is operated to cut the work edge in cooperation with a lower blade 1*a* during stitching operation, the upper blade being stopped and retreated to an inoperative position below the needle plate 30 in case the stitching operation is performed without necessity of cutting the work edge, the sewing machine substantially comprising a main drive shaft 2 which is rotated to vertically reciprocate a machine needle 31, a device for converting the rotation of the main drive shaft into vertical movement, a device for transmitting the vertical movement to the upper blade, a device for intercepting the transmission movement of the transmitting means, wherein the intercepting device is operated to cause the upper blade to retreat from the operative position to the inoperative position below the needle plate.

8 Claims, 7 Drawing Sheets

SEWING MACHINE WITH WORK EDGE CUTTING MECHANISM

BACKGROUND OF THE INVENTION

The present invention relates to a sewing machine and more particularly relates to an overolock sewing machine having a cutter mechanism for cutting the edge of work while the work is to sewn, wherein a blade which is activated may be kept stopped and held as placed under the needle plate in case a stitching operation is performed without use of the cutter mechanism.

It is generally known that the overlock sewing machine is provided with a work edge cutting mechanism including a movable blade which may be operatively disconnected from a drive source in case the stitching operation is performed without use of the work edge cutting mechanism. This type of sewing machine is disclosed in the Japanese patent application laid open Hei.11-235489. The sewing machine is described as follows; An upper blade 16 is operated in association with a link 28 which is vertically reciprocated by rotation of an eccentric cam 27, because the vertical reciprocation of the link 28 is transmitted to the upper blade 16 through a first arm 29, a second arm 30, a blade holder 22 and a holder guide 23. The upper blade 16 may be disconnected from the vertically reciprocating link 28 by manipulation of a changeover lever 38 in case the stitching operation is performed without use of the work edge cutting mechanism, the changeover lever 38 being operated to pull out a connecting pin 34 from an operative position to disconnect the first arm 29 and the second arm 30 from each other.

According to the sewing machine, the work edge cutting mechanism is so formed as to keep the upper blade as is stopped in a region where the upper blade is operated in case the upper blade is disconnected from a drive source. In the operative region, the upper blade is vertically moved to cut the work edge between an upper position and a lower position where the upper blade is partly located above the needle plate where the work is handled by the user to be sewn. The upper blade is, therefore, something in the way in the stitching operation in case the stitching operation is performed without use of the upper blade. It is, therefore, an object of the invention to eliminate the defects and disadvantages of prior art. More precisely, it is an object of the invention to disconnect the upper blade from the drive source and move the same into a retreat position where the upper blade is not in the way of stitching operation in case the stitching operation is performed without use of the upper blade, and to connect the upper blade to the drive source and revert the same into the operative region in case the stitching operation is performed with use of the upper blade.

SUMMARY OF THE INVENTION

The inventers have made efforts to solve the problems of prior art and succeeded in providing a sewing machine with work edge cutting mechanism having a main drive shaft which is rotated to vertically reciprocate a machine needle, the sewing machine substantially comprising: a cutting means for cutting the work edge while the work is stitched, the cutting means including a lower blade fixed to a place adjacent a needle plate of the sewing machine and an upper blade which is located in an upper operative position as is protruded up from the needle plate, the upper blade being operated in association rotation of the main drive shaft to cut the edge of work while the work is stitched; a transmission means for transmitting the rotation of the main drive shaft to the upper blade such that the upper blade may be vertically reciprocated relative to the lower blade; a transmission intercepting means for intercepting the transmitting operation of the transmission means; an operating means which is manipulated to activate the intercepting means; a retreating means operated in association with the operating means to retreat the upper blade from the upper operative position to a retreat position where said upper blade is inoperative.

According to the invention, the mechanism is simple and may be easily operated to disconnect the upper blade from the drive source and to retreat the same into the inoperative position outside of the operative region so that the upper blade may be not in the way of work stitching operation in case the stitching operation is performed without use of the upper blade. The upper blade may be easily connected to the drive source to revert the same to the operative position where the upper blade is operated to cut the edge of work while the work is stitched.

(a) is a front elevational view of the work edge cutting mechanism of the invention shown as is in operative condition.

(b) is a plan elevational view of an essential part of (a) shown partly in section and showing the upper blade of the work edge cutting mechanism operatively connected to a drive source.

FIG. 2

(a) is a front elevational view of the work edge cutting mechanism of the invention shown as is inoperative condition.

(b) is a plan elevational view of an essential part of (a) shown partly in section and showing the upper blade of the work edge cutting mechanism operatively disconnected from the drive source.

FIG. 3

(a) is a plan elevational view of an essential part of the work edge cutting mechanism of the invention showing the operating section moved to a first position for holding the mechanism operative.

(b) is a plan elevational view of the essential part of the work edge cutting mechanism of the invention showing the operating section moved to a second position for holding the mechanism inoperative.

FIG. 4

(a) is a perspective view of an essential part of the operating section of the work edge cutting mechanism.

(b) is an exploded view of an essential part of (a).

FIG. 5

Figure 4A:
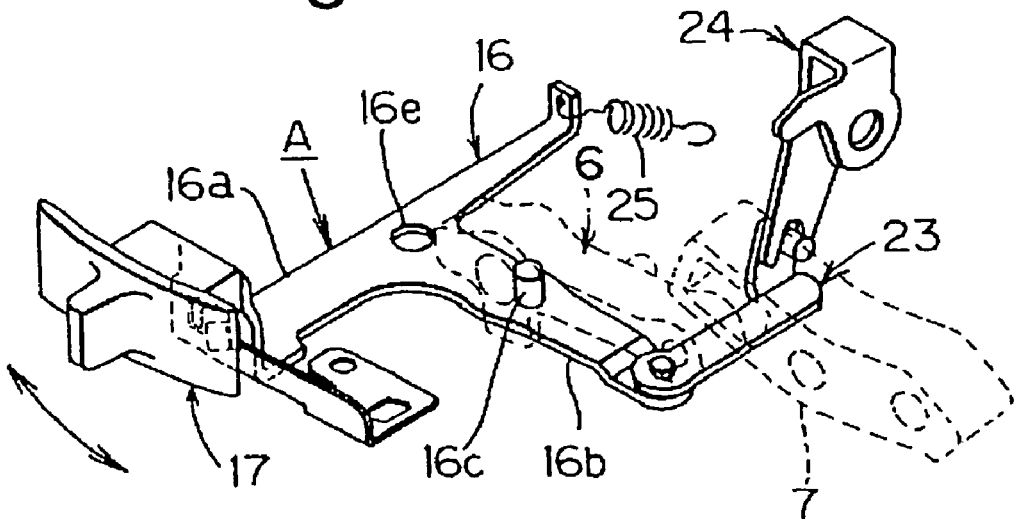
Figure 4B:
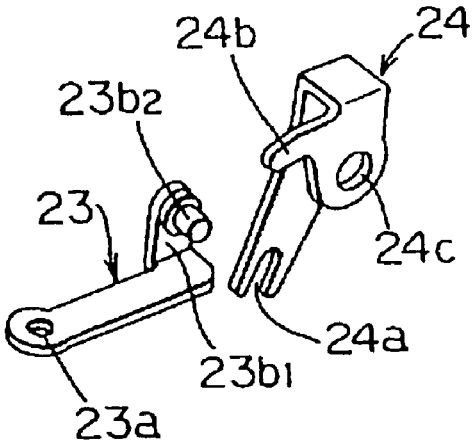

(a) is a side elevtional view of an essential part of FIG. 4 showing a reverting lever operated to render the work edge cutting mechanism into inoperative condition.

(b) is a side elevtional view of an essential part of FIG. 4 showing the reverting lever operated to render the work edge cutting mechanism into operative condition.

Figure 6:
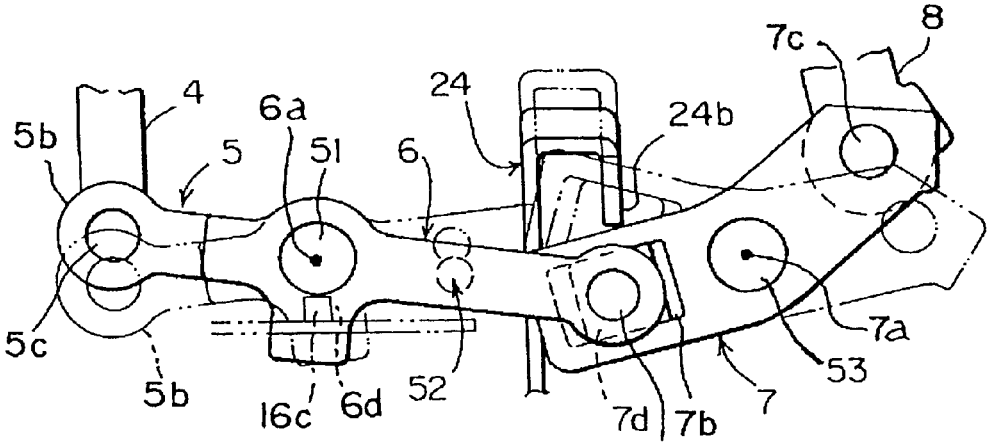
Figure 7A:
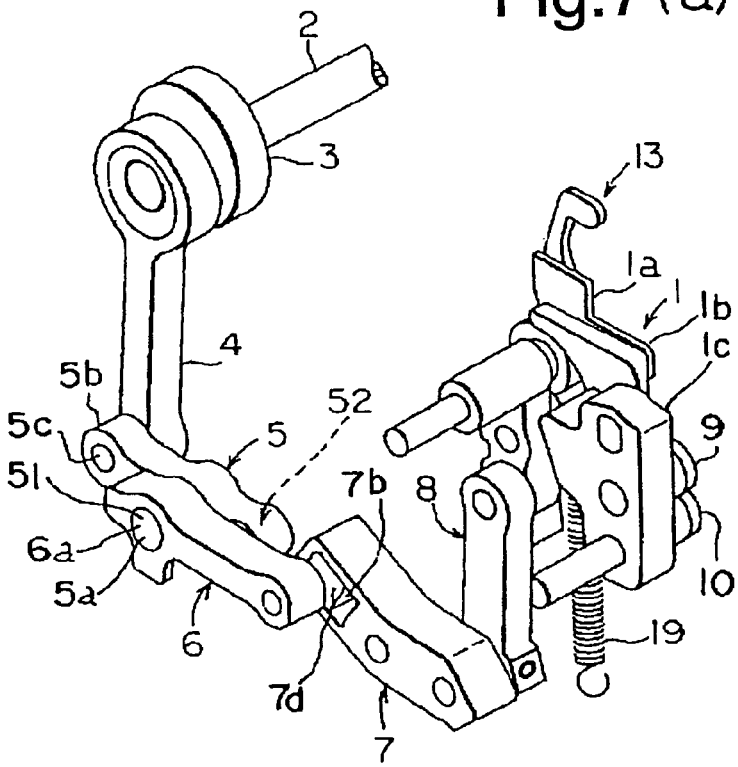
Figure 7B:
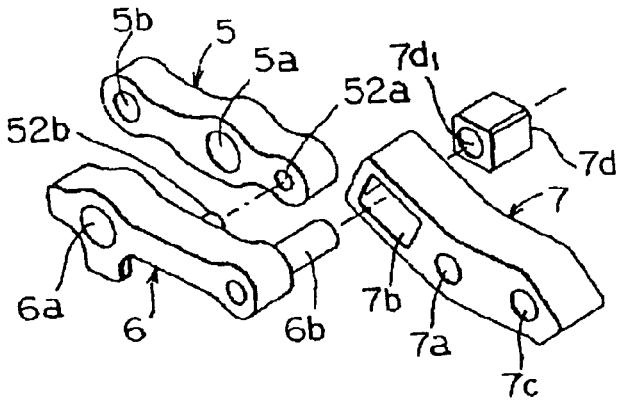
Figure 7C:
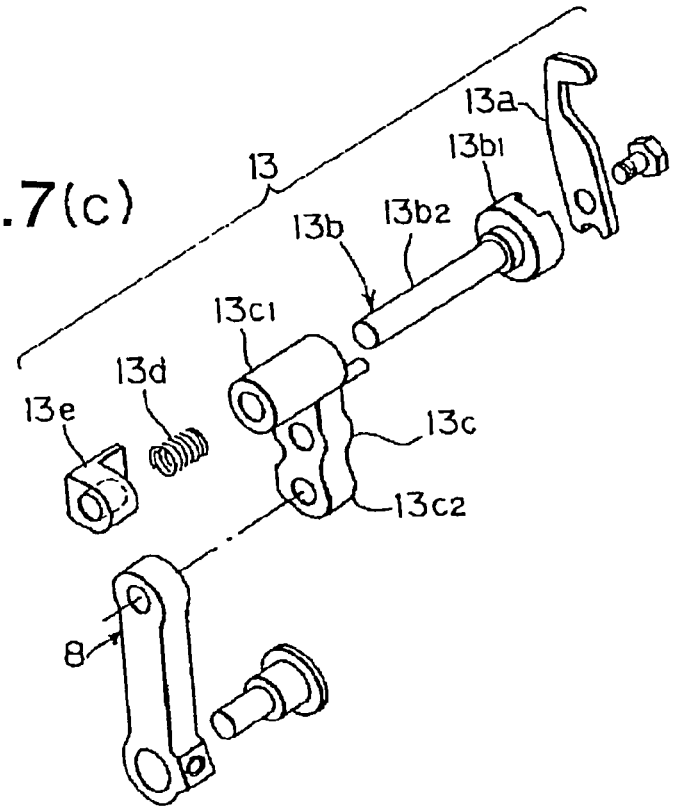
Figure 7D:
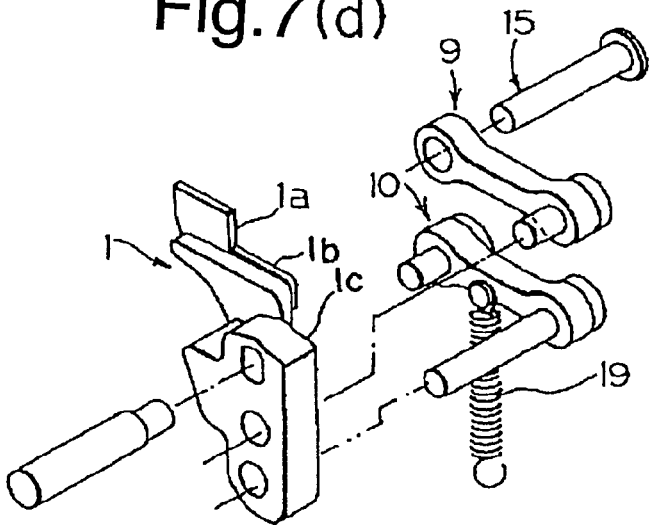

FIG. 6 is a front elevtional view of an essential part of the work edge cutting mechanism showing a transmission mechanism moved between an operative position and an inoperative position.

FIG. 7

(a) is a perspective view of an essential part of the work edge cutting mechanism.

(b) is an exploded perspective view of a part of (a).

(c) is an exploded perspective view of another part of (a).

(d) is an exploded perspective view of another part of (a).

DETAILED DESCRIPTION OF THE PREFERRED EMBODIMENTS

The invention will be described in detail in reference to the preferred embodiments as shown in the attached drawings. The invention is substantially composed of a drive mechanism moving an upper blade section 13 in a vertical plane, a transmission mechanism for transmitting the movement of the drive mechanism to the upper blade section 13, a mechanism for intercepting the transmission of the transmission mechanism and a mechanism which is manually operated to act on the intercepting mechanism.

The drive mechanism includes a main rotation shaft 2 of sewing machine, an eccentric cam 3 mounted to the main rotation shaft 2 and a transmission rod 4 having the upper end being in engagement with the eccentric cam 3 so that the transmission rod 4 may be vertically reciprocated when the main rotation shaft 2 is rotated. The transmission mechanism includes a first crank 5 having one end connected to the rod 4, a second crank 6 and a swingable arm 7. The transmission intercepting mechanism includes a connection 52 between the first crank 5 and the second crank 6. The manually operated mechanism includes the section as designated by a letter A.

A lower blade section 1 including a lower blade 1*a* is secured to a base 1*b* which is provided below a needle plate 30, the lower blade 1*a* having the edge provided at the upper side thereof An upper blade section 13 including an upper blade 13*a* is provided in connection with the lower blade 1*a,* such that the upper blade 13*a* may be vertically moved relative to the lower blade 1*a*.

The upper blade 13*a* is mounted to an upper blade holder 13*b* which is mounted to a connecting arm 13*c* as shown in FIG. 7(*c*). Precisely, the upper blade holder 13*b* is composed of a holder portion $\mathbf{13}b_1$ and a holder shaft $\mathbf{13}b_2$. The upper blade 13*a* is secured to the holder portion $\mathbf{13}b_1$ by a screw or the like, and the holder shaft $\mathbf{13}b_2$ is inserted into a cylinder base portion $\mathbf{13}c_1$ of the connecting arm 13*c* which has an arm portion $\mathbf{13}c_2$.

A spring 13*d* is provided between a stopper 13*e* and the holder shaft $\mathbf{13}b_2$ of the upper blade holder 13*b* to normally pressing the upper blade 13*a* toward the lower blade 1*a,* the pressure being required for the upper blade 13*a* to cut off the thread in cooperation with the lower blade 1*a*.

Figure 1A:
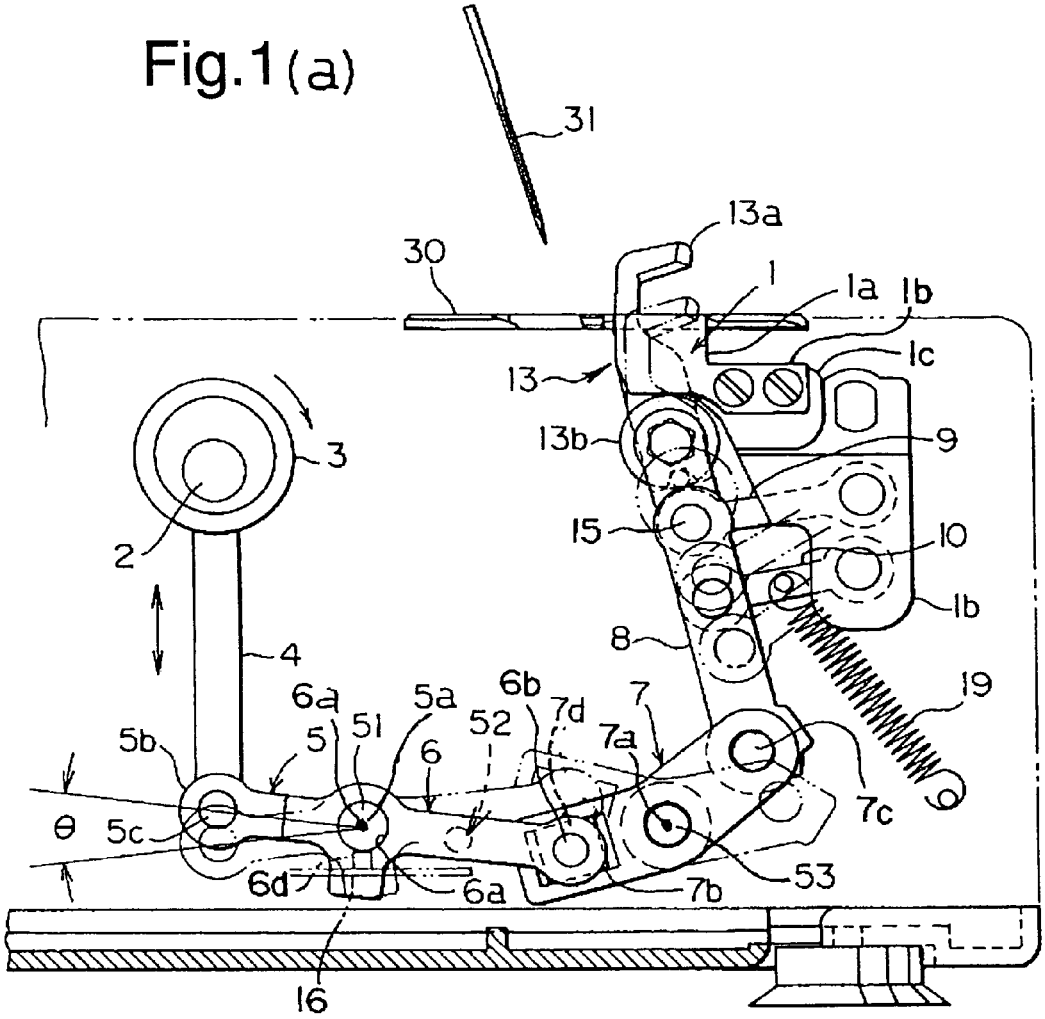
FIG. 1
Figure 1B:
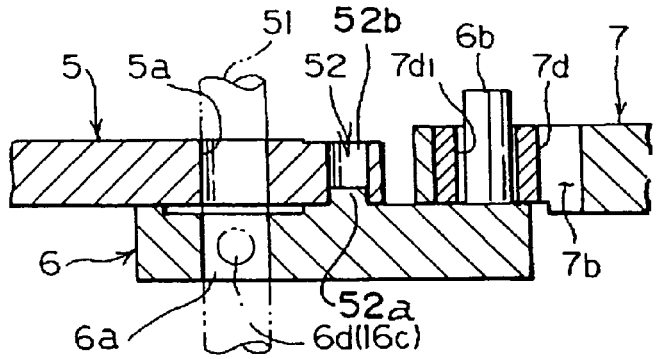
Figure 2:
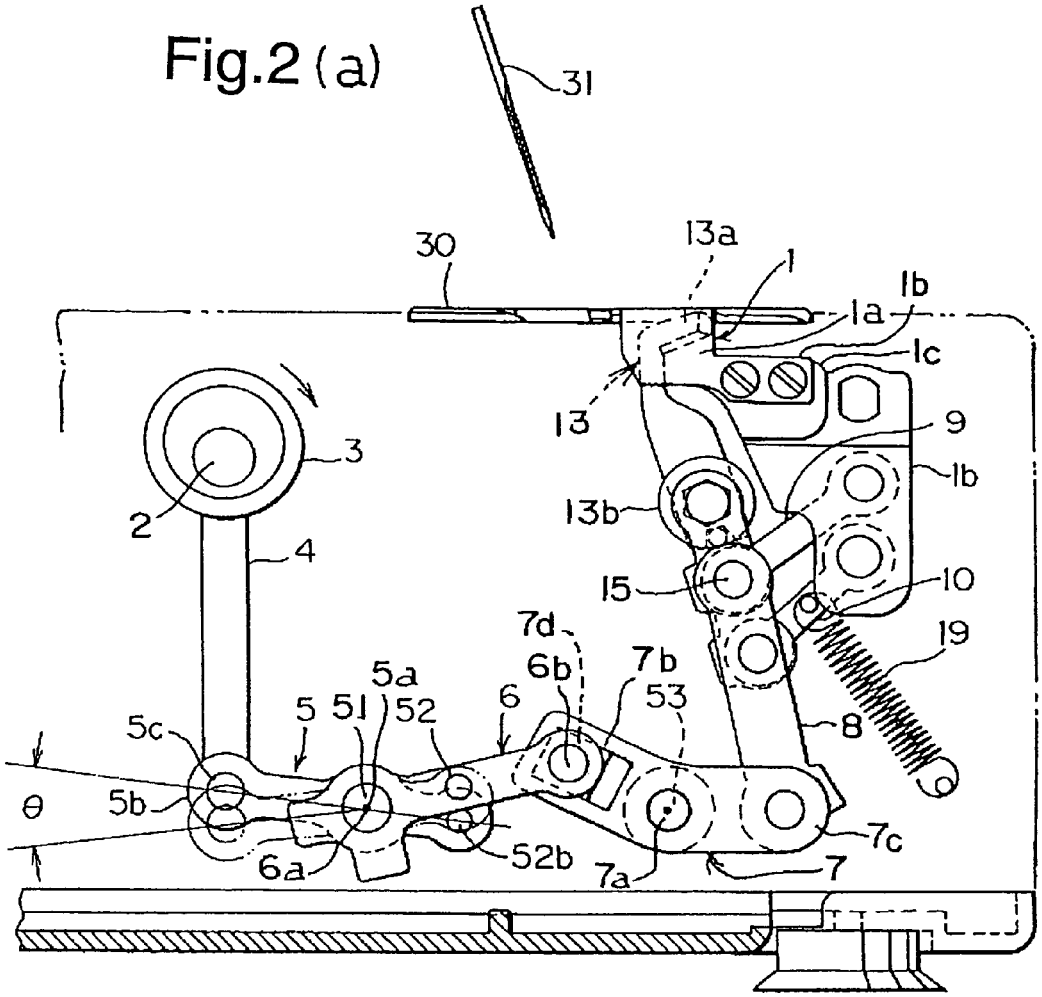
Figure 2:
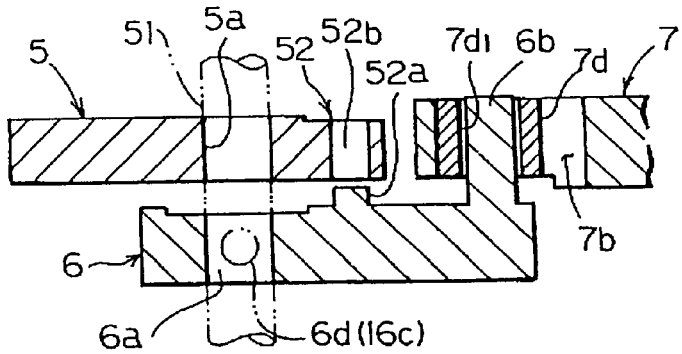

The upper blade connecting arm 13*c* is connected to a transmission link 8 by means of a connecting shaft 15. The base 1*b* of the lower blade 1*a* is secured to a mount 1*c* which is provided under the needle plate 30, so that the lower blade 1*a* may be located in a same plane with the needle plate 30, and so that the lower blade 1*a* may be located forward of the place where there are a needle drop hole and feed dogs. In FIGS. 1 and 2, a machine needle 31 is shown, and the first crank 5 has one end rotationally connected to the lower end of the transmission rod 4 by means of a pin 5*c*. The first crank 5 has the opposite end is rotationally connected to the second crank 6.

The axial reciprocation of the transmission rod 4 is transmitted to the first crank 5. As shown in FIG. 7(*b*), the first crank 5 has a central through hole 5*a* formed thereat. The second crank 6 has a through hole 6*a* formed at one end portion thereof and has a connecting shaft 6*b* provided at the opposite end thereof The first and second cranks 5,6 are connected by means a connecting shaft 51 which is inserted into the through hole 6*a* and the central through hole 5*a,* so that the first and second cranks 5,6 may be swingingly moved around the connecting shaft 51 as shown in FIGS. 1 and 2. The second crank 6 may be moved axially of the connecting shaft 51 and relative to the first crank 5.

With manual operation of the operating section A which will be described in detail hereinlater, the second crank 6 may be pressed against or spaced from the first crank 5 as shown in FIG. 1(*b*) and FIG. 2(*b*). Namely the second crank 6 may be moved toward and away from the first crank 5. Further as shown in FIG. 1(*b*), FIG. 2(*b*), FIG. 3 and FIG. 7, there is provided a connecting means 52 including a hole 52*a* formed on the first crank 5 at the opposite end thereof between the through hole 6*a* and the connecting shaft 6*b* of the second crank 6, and a projection 52*b* formed on the second crank 6 at the opposite end thereof. In case the projection 52*a* engages the hole 52*b* as the second crank 6 is moved toward the first crank 5, the first and second cranks 5,6 are operatively connected. On the other hand, in case the projection 52*a* disengages from the hole 52*b* as the second crank 6 is moved away from the first crank 5, the first and second cranks 5,6 are operatively disconnected.

When the first and second cranks 5,6 are operatively connected, the second crank 6 may be reciprocated in the axial direction thereof by the first crank 5. The is second crank 6 is normally pressed toward the second crank 6 by a torsion spring 18 which is arranged between the second crank 6 and a part of machine housing (not shown). The torsion spring 18 may be replaced by a coil spring.

Thus the first crank 5 and the second crank 6 are operatively connected by the connecting portion 52 when the projection 52*a* of the second crank 6 is inserted into the hole 52*b* of the first crank 5. On the other hand, the first crank 5 and the second crank 6 are operatively disconnected when the projection 52*a* of the second crank 6 is moved back from the hole 52*b* of the first crank 5. The connecting means 52 may be optionally modified in any ways other than the present embodiment.

With rotation of the upper rotation shaft 2, the eccentric cam 3 is rotated and the transmission rod 4 is vertically reciprocated as shown in FIG. 1(*a*). As the result, the first and second cranks 5,6 are swingingly moved around the connecting shaft 51 in case the first and second cranks 5,6 are operatively connected by the projection 52*a* of the second crank 6. The swinging movement of the first and second cranks 5, 6 is transmitted to the upper blade 13*a* through the swingable arm 7 which is connected to the opposite end of the second crank 6.

The swingable arm 7 is swingable around a shaft 53 which supports the swingable arm 7 at the center 7*a* thereof and is mounted to a machine housing (not sown). The swingable arm 7 has one end connected to the opposite end of the second crank 6 by means of a connecting shaft 6*b* which is secured to the opposite end of the second crank 6 as shown in FIGS. 1, 2 and FIG. 7(*a*).

Precisely, the swingable arm 7 has a triangular slide groove 7*b* formed at one end thereof A triangular slide block 7*d* is fitted into the triangular slide groove 7*b* such that the former may be slidingly moved in the latter. The triangular slide block 7*d* has a central hole $\mathbf{7}d_1$ formed thereat. The swingable arm 7 is connected to the second crank 6 by the connecting shaft 6*b* which is inserted into the central hole $\mathbf{7}d_1$ of the triangular slide block 7*d,* so that the swinging movement of the second crank 6 may be smoothly transmitted to the swingable arm 7 through the triangular slide block 7*d*.

The swingable arm 7 has an opposite end 7*c* operatively connected to a lower end of a transmission link 8. The transmission link 8 has an upper end operatively connected to the connecting arm 13*c*. The upper blade 13*a* is normally pulled down by a tension spring 19,so that the upper blade 13*a* may be moved down to below the needle plate 30 in case the second crank 6 is operatively disconnected from the first crank 5.

Precisely, as shown in FIG. 1(*a*), FIG. 2(*a*) and FIG. 7(*a*), the transmission link 8 is connected to the fixed base 1*b* of the lower blade 1*a* by means of a first link 9 and a second link 10 which are arranged in parallel with each other. The longitudinal length of the first and second links 9,10 is slightly different so that the upper blade 13*a* may be vertically moved as is slightly swingingly moved in the vertical plane. The tension spring 19 has one end hung to the second link 10 and has the opposite end anchored to the machine housing (not shown). Thus the upper blade 13*a* is normally pulled down by the tension spring 19.

Figure 3:
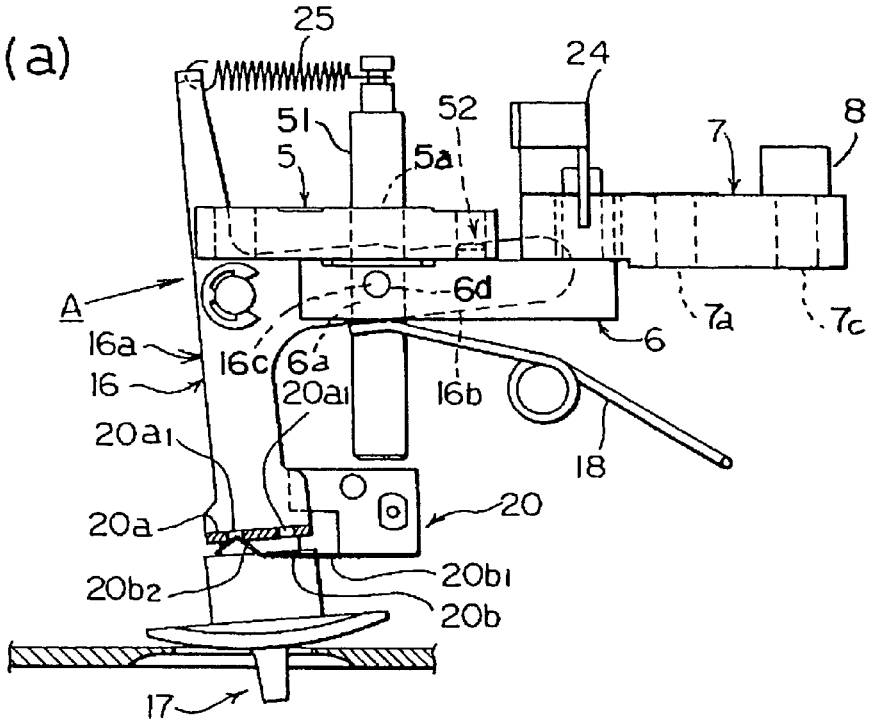
Figure 3:
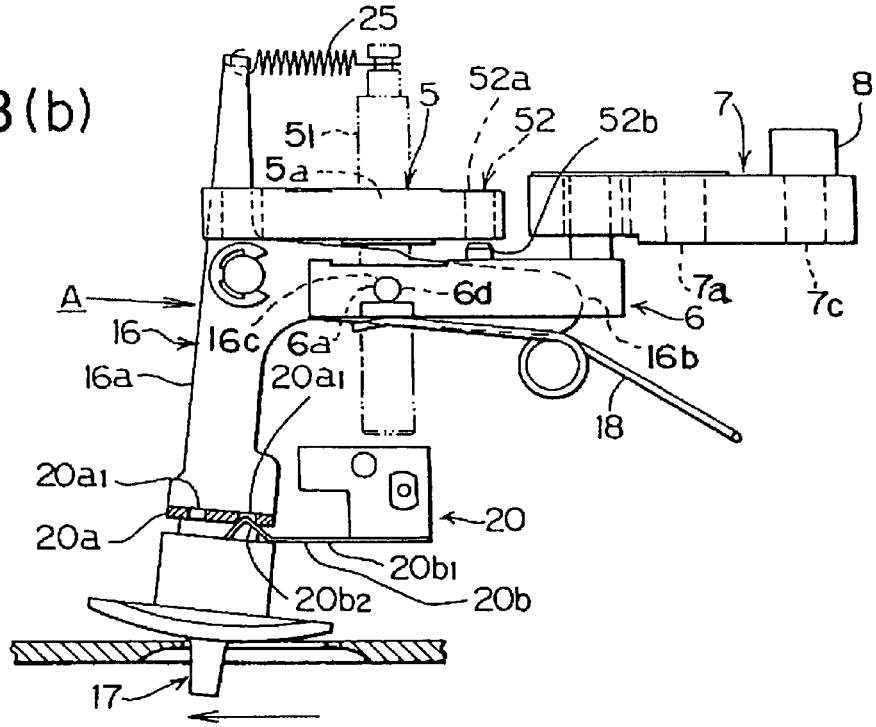

The manually operating section A includes a changeover lever 16, a transmission member 23 and a reverting lever 24 as shown in FIG. 3 and FIGS. 4(*a*), (*b*). The changeover lever 16 is substantially of a T-shape including an operating arm 16*a* and an activating arm 16*b* which is generally normal to the operating arm 1.

The changeover lever 16 is mounted to a machine housing (not shown) such that the same may be swingable around the center axis 16*e* thereof in the horizontal plane. A knob 17 is secured to one end of the operating arm 16*a* and is protruded out of the machine housing so that the same may be accessible at he outside of sewing machine. With operation of the knob 17, the changeover lever 16 is swingingly moved around the center axis 16*e*. The swinging movement of the lever 16 causes the second crank 6 to move and disconnect and disconnect toward and away from the first crank 5, thereby to connect and disconnect the former to and from the latter as will be described in detail hereinlater.

As shown in FIGS. 3(*a*), (*b*), the knob 17 may be moved between two positions where the knob 17 may be held by a holder 20 which is composed of a fixing portion 20*a* and a fixing spring 20*b*. The fixing portion 20*a* is provided on the operating arm 16*a* of the changeover lever 16 and the fixing spring 20*b* is provided on the machine frame. The fixing portion 20*a* is formed with two holes $\mathbf{20}a_1$, $\mathbf{20}a_1$ which are laterally spaced from each other.

The fixing spring 20*b* may be a plate spring $\mathbf{20}b_1$ which is bent at the free end thereof to provide a projection $\mathbf{20}b_2$. The projection $\mathbf{20}b_2$ is adapted to engage either of the holes $\mathbf{20}a_1$, $\mathbf{20}a_1$ of the fixing portion 20*a* as the changeover lever 16 is swinginly moved while the knob 17 is between the two positions as shown in FIGS. 3(*a*) and (*b*). Thus the changeover lever 16 may be held in the two positions. In one of the positions, the first and second cranks 5,6 are connected and in the other of the positions, the first and second cranks 5,6 are disconnected. In this connection, the changeover lever 16 is normally urged in one direction by a tension spring 25. The tension spring 25 has one end connected to the operating arm 16*a* of the changeover lever 16 and has the opposite end anchored to the connecting shaft 51. Namely the second crank6 is normally urged in the direction to be disconnected from the first crank 5.

Precisely, the activating arm 16*b* of the changeover lever 16 has a projection 16*c* which is in engagement with a hole 16*d* formed at the underside of the second crank 6 so that the second crank 6 may be moved axially of the connecting shaft 51toward and away from the first crank 5 with swinging movement of the changeover lever 16.

The free end of the activating arm 16*b* of the changeover lever 16 is connected to one end 23*a* of the transmission member 23. The transmission member 23 has a projection $\mathbf{23}b_2$ provided at the opposite end $\mathbf{23}b_1$ thereof which is bent up as shown in FIGS. 4(*a*), (*b*). The projection $\mathbf{23}b_2$ is in engagement with a forked portion 24*a* provided at the lower end of the reverting lever 24 which is mounted to the machine frame so as to be swingable around the swing center 24*c* thereof.

Figure 5A:
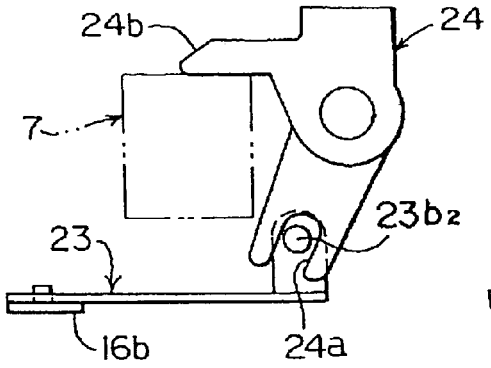
Figure 5B:
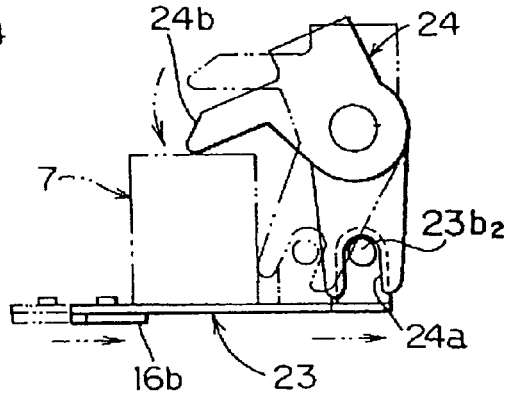

The reverting lever 24 is further provided with a projection 24*b* which is adapted to press down the swingable arm 7 in the counterclockwise direction in FIG. 6 as the reverting lever 24 is swingingly moved as shown in FIGS. 5(*a*), (*b*) and FIG. 6. With the operation of the reverting lever 24, the connection and disconnection between the first and second cranks 5,6 may be easily and smoothly made through the hole 52*a* and the projection 52*b*.

Precisely, in the condition that the second crank 6 is disconnected from the first crank 5 with the projection 52*b* is pulled out of the hole 52*a* of the first crank 5, it is designed that the projection 52*b* is located outside of the swing region of the first crank 5 which is defined by the swing angle θ of the first crank 5 as shown in FIG. 2, wherein the upper blade 13*a* and the transmission 8 are normally urged in the lower direction by the tension spring 19 and the swingable arm 7 is swingingly moved in the clockwise direction and the connecting point between the second crank 6 and the swingable arm 7 is moved to the upper position. In this condition, the swinging movement of the first crank 5 will not cause the hole 52*a* to interfere with the projection 52*a* of the second crank 6.

In order to connect the second crank 6 to the first crank 5, the knob 17 of the operating section A is manually operated to swing the reverting lever 24 in the counterclockwise direction as shown in FIGS. 5(*a*), (*b*) through the transmission member 23. Then the projection 24*b* of the reverting lever 24 moves the swingable lever 7 in the counterclockwise direction as shown in FIG. 6 so that the second crank 6 may be moved in the clockwise direction into the swing region of the first crank 5 wherein the torsion spring 18 moves the second crank6 axially of the connecting shaft 51 toward the first crank 5. In this condition, the projection 52*b* of the second crank 6 may enter the hole 52*a* of the first crank 5 as the hole 52*a* comes in alignment with the projection 52*b*.

Thus the first and second cranks 5, 6 connected in one body transmits the vertical reciprocating movement of the transmission rod 4 to the upper blade 13*a* through the swingable arm 7 and the transmission link 8. The upper blade 13*a*, therefore, may be operated while the sewing machine is operated.

In case the stitching operation of sewing machine is performed without requiring the operation of the work edge cutting mechanism, the knob 17 of the operating section A is manually moved from the position as shown in FIG. 3(*a*) to the position as shown FIG. 3(*b*). Then the changeover lever 16 is turned in the clockwise direction. Simultaneously the projection 16*c* of changeover lever 16 moves the second crank 6 away from the first crank 5 axially of the connecting shaft 51 and against the action of the torsion spring 18. The projection 52*a* of the second crank 6 is disengaged from the hole 52*b* of first crank 5. Thus the second crank 6 is disconnected from the first crank 5.

In the condition that the second crank 6 is disconnected from the first crank 5, the second crank 6 is turned in the counterclockwise direction around the axis 51 in FIG. 2(*a*) by the swingable arm 7 which is normally urged in the clockwise direction around the axis 53 by the tension spring 19 through the connecting link 10 and the transmission link 8. Thus the projection 52*a* of the second crank 6 is held at an upper position that is out of the swing region of the first crank 5. Simultaneously the upper blade 13*a* is retreated from the upper operative position as shown in FIG. 1(*a*) to the lower inoperative position where the upper blade 13*a* is located under the needle plate 30 as shown in FIG. 2, by the transmission link 8 which is normally urged in the lower direction by the tension spring 19.

In this instance, the projection 52*a* of the second crank 6 is located out of the swing locus of the hole 52*b* of the first crank 5. Therefore, the projection 52*a* will not engage the hole 52*b* in any way. This disconnected condition is maintained by the holder 20, wherein one of the holes $\mathbf{20}a_1$, $\mathbf{20}a_1$ of the fixing portion 20*a* is in engagement with the projection $\mathbf{20}b_2$ of the plate spring $\mathbf{20}b_1$ as shown in FIG. 3(*b*). Thus the upper blade 13*a* is held in the inoperative position below the needle plate 30.

As is apparent from the foregoing description of the invention, the upper blade 13*a* may be easily disconnected from the drive mechanism and may be simultaneously retreated to the inoperative position below the needle plate 30 where the upper plate 13*a* is not in the way of stitching operation in case the sewing machine is driven without necessity of operation by the work edge cutting mechanism.

The invention thus described, it will be obvious that the same may be varied in many ways. Such variations are not to be regarded as a departure from the spirit and scope of the invention, and all modifications are intended to be included within the scope of the following claims.

What is claimed is:

1. A sewing machine with work edge cutting mechanism having a main drive shaft which is rotated to vertically reciprocate a machine needle, said sewing machine comprising:

a cutting means for cutting the work edge while the work is stitched, said means including a lower blade fixed to a place adjacent a needle plate of the sewing machine and an upper blade which is located in an upper operative position as is protruded up from the needle plate, said upper blade being operated in association with rotation of said main drive shaft to cut the edge of work;

a transmission means for transmitting the rotation of said main drive shaft to said upper blade such that the upper blade may be vertically reciprocated relative to said lower blade;

a transmission intercepting means for intercepting the transmitting operation of said transmission means;

an operating means which is manipulated to activate said intercepting means;

a retreating means operated in association with said operating means to retreat said upper blade from said upper operative position to a retreat position where said upper blade is inoperative.

2. The sewing machine as defined in claim 1, wherein said retreating means is operated in association with the activation of said transmission intercepting means to said retreat position.

3. The sewing machine as defined in claim 1, wherein said retreat position located is below said needle plate.

4. The sewing machine as defined in claim 1, wherein said retreating means includes a tension spring normally urging said upper blade in the lower direction, said tension spring being operative to move said upper blade down to said retreat position as said transmission intercepting means intercepts the transmitting operation of said transmission means.

5. The sewing machine as defined in claim 1, wherein:

said transmission means includes an eccentric cam secured to said main drive shaft;

a transmission rod having one end connected to said eccentric cam;

a first crank having one end connected to the opposite end of said transmission rod so that said first crank may be swingingly moved by said transmission rod;

a second crank connected to said first crank such that the former may be swingingly moved with the latter;

a swingable arm having one end connected to said second crank; and a transmission link having one end connected to the opposite end of said swingable arm and having the opposite end connected to said upper blade.

6. The sewing machine as defined in claim 1, wherein said transmission intercepting means includes a changeover lever which is moved in one direction in response to manipulation of said operating means to disconnect said second crank from said first crank.

7. The sewing machine as defined in claim 5, wherein said second crank is connected to said first crank with a projection of said second crank being in engagement with a hole of said first crank.

8. The sewing machine as defined in claim 7, wherein said second crank is disconnected from said first crank while said changeover lever moves said second crank away from said first crank to disengage a projection of said second crank from a hole of said first crank.

* * * * *